US005092807A

United States Patent [19]

Lew et al.

[11] Patent Number: 5,092,807

[45] Date of Patent: * Mar. 3, 1992

[54] HELICAL FLOW OPTICALLY DECORATED BATON

[76] Inventors: Hyok S. Lew, 7890 Oak St., Arvada, Colo. 80005; John W. Elias, 3018 4th St., Boulder, Colo. 80302

[ * ] Notice: The portion of the term of this patent subsequent to Jul. 15, 2003 has been disclaimed.

[21] Appl. No.: 711,487

[22] Filed: Mar. 13, 1985

Related U.S. Application Data

[63] Continuation-in-part of Ser. No. 702,688, Feb. 19, 1985, Pat. No. 4,600,974.

[51] Int. Cl.[5] ..... A63H 23/00

[52] U.S. Cl. ..... 446/159; 446/267

[58] Field of Search ..... 362/102, 202, 34, 109; 84/477 B; 446/219, 267, 236, 153, 159; D21/100; D3/7

[56] References Cited

U.S. PATENT DOCUMENTS

| | | | |
|---|---|---|---|
| D. 250,554 | 12/1978 | Hardy | D3/7 |
| 2,361,423 | 10/1944 | Snyder | 446/153 |
| 3,531,635 | 9/1970 | Hancock | 362/101 |
| 4,090,324 | 5/1978 | Compton | 446/267 |
| 4,106,079 | 8/1978 | Drury | 84/477 B |
| 4,208,701 | 6/1980 | Schock | 362/102 |

FOREIGN PATENT DOCUMENTS

| | | | |
|---|---|---|---|
| 1211877 | 1/1959 | France | 446/236 |

*Primary Examiner*—E. Rollins Cross

[57] ABSTRACT

This invention relates to an optically decorated elongated member comprising a transparent tube sealed at both ends including one or more brightly colored thin elongated members disposed in a helical configuration therein and containing a fluid medium suspending numerous light-reflecting platelets filling thereof with a small volume of air space.

3 Claims, 1 Drawing Sheet

HELICAL FLOW OPTICALLY DECORATED BATON

This is a continuation-in-part application to patent application Ser. No. 702,688 entitled "Optically decorated baton" filed on Feb. 19, 1985, which is now U.S. Pat. No. 4,600,974.

BACKGROUND OF THE INVENTION

A baton made of a transparent tube sealed at both ends and containing a fluid suspending numerous light-reflecting particles of single or multiple colors, that fills the transparent tube with an air space, provides an interesting toy for children as well as for grown up people, as those light-reflecting particles suspended in the fluid display almost hallucinating pattern of random movements when the fluid is agitated by the air gap traveling therethrough as the baton is tilted back and forth. Such an optically decorated baton may be used as a simple toy as well as twirling baton and as a decorative marker or handle for dog leashes, key chains etc. The visual effect of the afore-mentioned baton can be drastically improved by adding a novel color pattern thereto and introducing a sort of ordered movement of the light-reflecting particles to the random movements thereof.

The primary object is to provide an optically decorated baton including one or more of brightly colored thin cords or ribbons disposed in a helical pattern therein.

Another object is to provide an optically decorated baton wherein the movement of the fluid and the suspended particles therein created by an air gap traveling therethrough is a combination of random type movements and ordered motions of helical patterns associated with the helical cords or ribbons included in the optically decorated baton.

A further object is to provide an optically decorated baton that displays more bold and accentuated color patterns that are visible from a sizable distance when the optically decorated baton is twirled.

These and other objects of the present invention will become clear as the description thereof proceeds.

BRIEF DESCRIPTION OF THE FIGURES

The present invention may be described with a greater clarity and specificity by referring to the following figures.

DESCRIPTION OF THE ILLUSTRATED EMBODIMENTS

Figure 1:
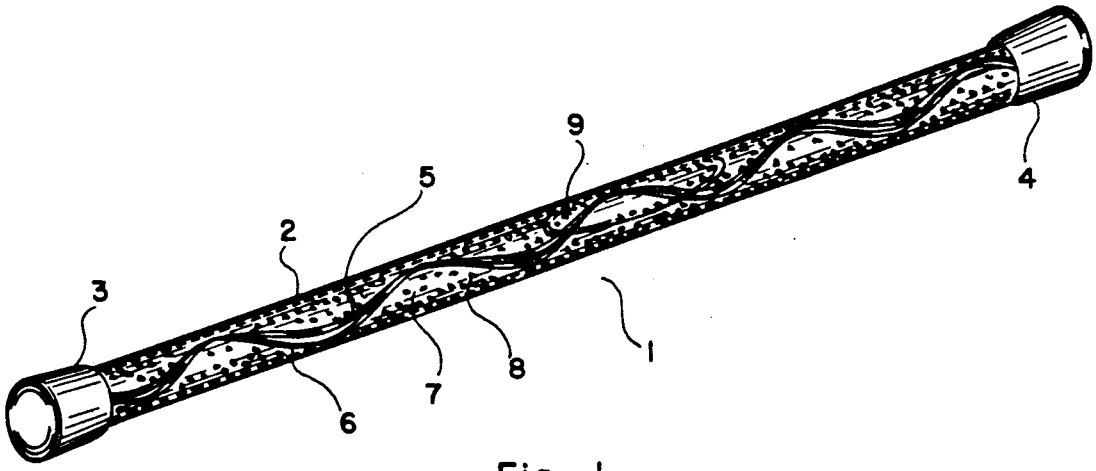
FIG. 1 illustrates a perspective view of an embodiment of the present invention.

In FIG. 1 there is illustrated a perspective view of a helical flow optically decorated baton 1 constructed in accordance with the principles of the present invention. The helical flow optically decorated baton 1 comprises a transparent tube 2 with both ends sealed with a pair of caps 3 and 4, and a plurality of bright and multiple colored cords or ribbons 5, 6, and like members disposed in a helical configuration within the transparent tube 2 wherein the cords or ribbons 5, 6, and like members are placed following the inside cylindrical surface of the transparent tube 2. The space inside of the sealed transparent tube 2 is nearly but not fully filled with a fluid medium 7 suspending numerous light reflecting particles 8 of single or multiple colors. The air gap 9 is an important element for it agitates the fluid medium 7 and creates spectacular random movements of the light-reflecting particles as the air gap 9 travels through the fluid medium 7 when the baton 1 is tilted back and forth or up and down. The helical coils of cords or ribbons 5, 6, and like members play the role of flow guide vanes in creating helical movements of the fluid medium and orbiting movements of the light-reflecting particles when the air gap 9 travels back and forth between to extremities of the baton 1. The combination of the orbiting movements of the light-reflecting particles mixed with random movements thereof and the novel color patterns displayed by the helical ribbons provides a spectacular visual effect that is fascinating and hallucinating at the level best far exceeding a baton without the helical ribbons.

Figure 2:
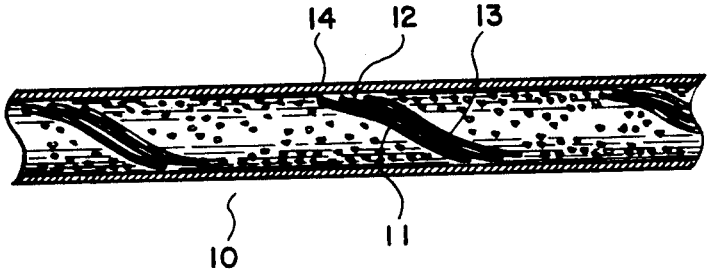
FIG. 2 illustrates a partially broken away view of another embodiment of the present invention.

In FIG. 2 there is illustrated a partially broken away view of a segment of another embodiment of the present invention taken along a plane including the central axis of the baton. The helical flow optically decorated baton 10 includes a plurality of cords or ribbons 11, 12, 13 etc. placed side by side and disposed in a helical pattern within the transparent tube 14 containing a fluid suspending numerous light-reflecting platelets. It is usually preferred to employ a plurality of cords or ribbons of multiple color combination.

Figure 3:
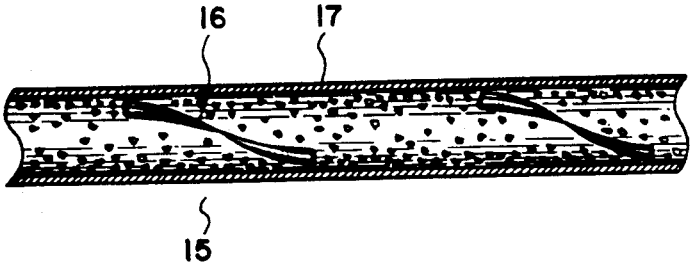
FIG. 3 illustrates a partially broken away view of a further embodiment of the present invention.

In FIG. 3 there is illustrated a partially broken away view of a segment of a further embodiment of the present invention. The helical flow optically decorated baton 15 includes a substantially flat ribbon 16 decorated with multiple color strips, that is disposed in a helical pattern within the transparent tube 17 containing a fluid medium suspending numerous light-reflecting colored particles. Of course, more than one ribbon of a helical pattern may be included within the transparent tube 17.

Figure 4:
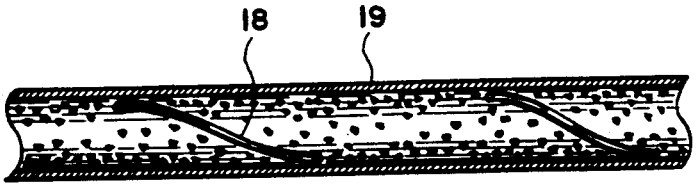
FIG. 4 illustrates a partially broken away view of yet another embodiment of the present invention.

In FIG. 4 there is illustrated a partially broken away view of a segment of yet another embodiment of the present invention that employs a single rod or strip 18 of small cross-section dimension disposed in a helical pattern within the transparent tube 19 containing a fluid medium suspending numerous light-reflecting platelets. The helical cords, ribbons, rods or strips disposed within the transparent tube may be of bright colors of fluorescent or phosphorescent nature.

While the principles of the present invention have now been made clear by the illustrative embodiments, it will be obvious to those skilled in the art many modifications of the structures, arrangements, proportion, elements and materials which are particularly adapted to the specific working environments and operating conditions in the practice of the invention without departing from those principles.

We claim:

1. A helical flow optically decorated baton comprising in combination:

a) a transparent tube with both ends sealed with a pair of caps;

b) at least one thin elongated member of bright color disposed in a helical pattern within said transparent tube for guiding air gaps moving from one extremity to the other expremity of said transparent tube in a helical path;

c) a fluid medium contained in said transparent tube;

d) a plurality of light-reflecting platelets of bright color included in said fluid medium; and e) an air gap included within said transparent tube.

2. The combination as set forth in claim 1 wherein said at least one thin elongated member of bright color includes fluorescent color.

3. The combination as set forth in claim 1 wherein said at least one thin elongated member of bright color includes phosphorescent coating.

* * * * *

UNITED STATES PATENT AND TRADEMARK OFFICE

CERTIFICATE OF CORRECTION

PATENT NO. : 5,092,807

DATED : March 3, 1992

INVENTOR(S) : Hyok S. Lew, et al

It is certified that error appears in the above-identified patent and that said Letters Patent is hereby corrected as shown below:

On the title page [*] Notice: should read

--The portion of the term of this patent subsequent to February 3, 2007 has been disclaimed.--

Signed and Sealed this

Thirteenth Day of October, 1992

*Attest:*

DOUGLAS B. COMER

*Attesting Officer*

*Acting Commissioner of Patents and Trademarks*